United States Patent [19]

Hancock et al.

[11] Patent Number: 5,002,201

[45] Date of Patent: Mar. 26, 1991

[54] BOTTLED WATER COOLER APPARATUS AND METHOD

[75] Inventors: Mark W. Hancock, Bel Air; Richard K. McKibbin, La Canada, both of Calif.

[73] Assignee: Aquatec Inc., Sun Valley, Calif.

[21] Appl. No.: 249,831

[22] Filed: Sep. 14, 1988

[51] Int. Cl.[5] ..... B67D 5/08

[52] U.S. Cl. ..... 222/61; 222/66; 222/129.1; 222/146.6; 261/DIG. 7

[58] Field of Search ..... 261/110, DIG. 7; 222/52, 54, 61, 64, 66, 129.1–129.4, 146.6, 190

[56] References Cited

U.S. PATENT DOCUMENTS

| | | | |
|---|---|---|---|
| 27,274 | 1/1852 | Mattingly | 128/66 |
| 27,775 | 4/1860 | Chamberlain . | |
| 780,714 | 1/1905 | Ferry . | |
| 1,115,980 | 11/1914 | Sleeper . | |
| 1,126,662 | 1/1915 | Stuhler | 261/35 |
| 1,872,462 | 8/1932 | Johnson et al. . | |
| 2,183,561 | 12/1939 | Hamblin | 261/DIG. 26 |
| 2,391,003 | 12/1945 | Bowman | 261/93 |
| 2,560,526 | 7/1951 | Thompson | 261/26 |
| 2,588,677 | 3/1952 | Welty et al. | 261/27 |
| 2,604,310 | 7/1952 | Brown | 261/35 |
| 2,674,263 | 4/1954 | Rupp et al. | 137/604 |
| 2,708,533 | 5/1955 | Nicholas | 222/146 |
| 2,735,370 | 2/1956 | Lance | 103/118 |
| 2,735,665 | 2/1956 | Lance | 261/27 |
| 2,750,076 | 6/1956 | Welty et al. | 222/129.1 |
| 2,798,135 | 7/1957 | Graham | 200/152 |
| 2,823,833 | 2/1958 | Bauerlein | 222/129.2 |
| 2,894,377 | 7/1959 | Shikles, Jr. et al. | 62/306 |
| 2,988,343 | 6/1961 | Edwards et al. | 261/84 |
| 3,199,738 | 8/1965 | Cary et al. | 222/129.2 |
| 3,225,965 | 12/1965 | Jacobs et al. | 222/129.1 |
| 3,292,822 | 12/1966 | Crowder et al. | 222/129.1 |
| 3,382,897 | 5/1968 | Skiera et al. | 141/107 |
| 3,397,870 | 8/1968 | McCann et al. | 261/19 |
| 3,408,053 | 10/1968 | Vantroba | 261/27 |
| 3,495,803 | 2/1970 | Schoepe et al. | 251/25 |
| 3,552,726 | 1/1971 | Kraft | 261/50 |
| 3,618,905 | 11/1971 | Primue | 261/153 |
| 3,688,950 | 9/1972 | Parish | 222/146.1 |
| 3,726,102 | 4/1973 | Parks | 62/70 |
| 3,756,473 | 9/1973 | Donahue, Jr. | 222/129.2 |
| 3,756,576 | 9/1973 | Tremolada | 261/35 |
| 3,761,066 | 9/1973 | Wheeler | 261/78 |
| 3,809,292 | 5/1974 | Booth et al. | 222/146 |
| 3,926,102 | 12/1975 | De Lepeieire | 98/102 |
| 3,926,342 | 12/1975 | Selvia et al. | 222/129.1 |
| 4,068,010 | 1/1978 | Karr | 426/477 |
| 4,093,681 | 6/1978 | Castillo et al. | 261/122 |
| 4,108,167 | 8/1978 | Hickman et al. | 128/66 |
| 4,148,334 | 4/1979 | Richards | 137/389 |
| 4,173,178 | 11/1979 | Wieland | 99/323.1 |
| 4,205,599 | 6/1980 | Franzosi | 99/323.1 |
| 4,216,885 | 8/1980 | Sedam | 222/481 |
| 4,222,825 | 9/1980 | Eisden | 203/11 |
| 4,225,537 | 9/1980 | Martonffy | 261/70 |
| 4,229,634 | 10/1980 | Hickman et al. | 200/302 |
| 4,242,061 | 12/1980 | Hartley | 417/536 |
| 4,302,186 | 11/1981 | Cammack et al. | 433/80 |
| 4,304,736 | 12/1981 | McMillin et al. | 261/35 |
| 4,316,409 | 2/1982 | Adams et al. | 99/275 |
| 4,359,432 | 11/1982 | Sedam et al. | 261/26 |
| 4,401,607 | 8/1983 | Child et al. | 261/121 |
| 4,422,371 | 12/1983 | Child et al. | 99/323.1 |
| 4,440,318 | 4/1984 | Berger | 222/129.1 |
| 4,466,342 | 8/1984 | Basile et al. | 99/323.1 |
| 4,475,448 | 10/1984 | Shoaf et al. | 99/323.1 |
| 4,509,569 | 4/1985 | Adolfsson | 141/360 |
| 4,518,541 | 5/1985 | Harris | 261/27 |
| 4,545,505 | 10/1985 | Mueller et al. | 222/146.6 X |
| 4,564,483 | 1/1986 | Jeans | 261/64 |
| 4,588,536 | 5/1986 | Adolfsson | 261/DIG. 7 |
| 4,597,509 | 7/1986 | Pereira | 222/129 |
| 4,632,275 | 12/1986 | Parks | 222/25 |
| 4,635,824 | 1/1987 | Gaunt et al. | 222/129.1 |
| 4,655,124 | 4/1987 | Child | 99/323.2 |
| 4,659,520 | 4/1987 | Tarvor | 261/82 |
| 4,660,741 | 4/1987 | Kirschner et al. | 222/1 |
| 4,703,870 | 11/1987 | Sedam | 222/66 |
| 4,708,827 | 11/1987 | Millin | 261/DIG. 7 |
| 4,719,056 | 1/1988 | Scott | 261/DIG. 7 |
| 4,729,495 | 3/1988 | Aschberger et al. | 222/56 |
| 4,742,939 | 5/1988 | Galockin | 222/68 |

*Primary Examiner*—Michael S. Huppert
*Assistant Examiner*—Gregory L. Huson
*Attorney, Agent, or Firm*—A. C. Smith

[57] ABSTRACT

A water dispensing system and method for carbonating water from a bottled water supply includes a carbonator that is controlled by electrical components which are coupled to fluid lines associated with the carbonator for remotely controlling the liquid level in the carbonator in response to the volumetric absorption of carbon dioxide in water.

3 Claims, 9 Drawing Sheets

| FIG. 1A | FIG. 1B |
|---|---|

BOTTLED WATER COOLER APPARATUS AND METHOD

RELATED APPLICATIONS

The subject matter of this application relates to pending applications Ser. No. 67,803 entitled "Gas Driven Carbonator and Method" filed on June 26, 1987 by Mark W. Hancock and Marvin M. May, now issued as U.S. Pat. No. 4,859,376, and Ser. No 68,017 entitled "Improved Drink Dispenser and Method of Preparation" filed on June 26, 1987 by Mark W. Hancock and Marvin M. May, now issued as U.S. Pat. No. 4,940,163 and Ser. No. 68,018 entitled "Low-Pressure, High-Efficiency Carbonator and Method" filed on June 26, 1987 by Mark W. Hancock and Marvin M. May, now issued as U.S. Pat. No. 4,850,269, the subjects matter of which applications are incorporated herein by reference.

BACKGROUND OF THE INVENTION

This invention concerns bottled water dispensing systems in general and also bottled water dispensing systems equipped to supply carbonated water derived from a bottled water source.

Bottled water dispensers of the type which are in common current use in the United States employ an inverted bottle, the neck of which extends into a reservoir which is housed in the body of the dispenser. This reservoir may or may not be provided with means for chilling the water. This arrangement is inherently unsanitary due to contact between the exterior neck and top of the bottle and the water in the reservoir. The bottled water consumer is advised to clean the top of the bottle before inverting it, but this is rarely done to a sufficient extent.

Furthermore, the principle of operation of inverted-bottle-type dispensers requires that air enter the space between the mouth of the inverted bottle and the top of the water level in the reservoir. Airborne microbes and small particulate matter can enter the drinking water system each time the bottle demands air and "glugs." This has prompted devices which filter or limit the pathway of the air entering the system.

Current dispenser systems typically do not provide the kind of seal necessary to eliminate contamination of the system from spillage of liquid on top of the bottle. Such liquid can come from a variety of sources including overwatering of plants placed on top of the inverted bottle. The liquid can then run down the sidewalls of the bottle and into the system. Similarly, certain animals, such as parrots, have been known to light on top of the bottle and contaminate conventional systems by urinating on top of the bottle.

Conventional bottled water dispensing systems also have two additional drawbacks: first, they require that the consumer or installer lift and invert a heavy bottle; second, conventional systems often require more space than that which is available in today's kitchen.

Carbonated beverage dispensing systems need to dispense carbonated liquid at very close to freezing temperatures in order to retain high levels of carbonation in the dispensed liquid. In this regard, carbonated beverage dispensing systems using bottled water sources have presented special engineering challenges because of the desirability of using the thermal storage characteristics of ice banks while still maintaining compact size and existing electromechanical packaging. Carbonated beverage dispensing systems which use bottled water sources have also employed refrigeration controls which can be both ambient temperature and altitude sensitive. These sensitivities can cause differences in the amount or even presence of ice in the unit which can directly affect drink dispensing temperature, carbonation level and drink making capacity. The adjustment required to compensate for different altitude and ambient temperature environments constitutes a further drawback to the use of conventional bottled water temperature controls. Although conventional controls may be adjustable, such a system introduces an interface between user or installer which requires judgment or training and constitutes a sales negative.

Furthermore, some known carbonator configurations include carbonator vessels wrapped with refrigeration coils (see, for example, FIG. 8 in pending application Ser. No. 068,017). It is often desirable to operate the evaporator at a subfreezing temperature in such systems. Naturally, this makes such a system prone to freezing of the fluid in the carbonator. Further, level sensors having moving parts to control supply pumps can present operating problems. It may be necessary to adjust the evaporator temperature used in production of such systems slightly higher in order to avoid the possibility of icing up the carbonator. This translates to a dispensing temperature which is marginally higher with concomitant reduction in carbonation level during dispensing.

SUMMARY OF INVENTION

In accordance with one embodiment of the present invention, an improved carbonator is provided which has no moving parts, and which can be easily serviced. The carbonator system and method may be operated remotely by electrical components coupled to fluid lines that are connected to the carbonator. In this manner, the liquid level in the carbonator is remotely controlled in response to the volumetric absorption of carbon dioxide in water as a function predominately of the temperature of the water supplied to the carbonator. Two embodiments of the present carbonator method and system are adapted for operation as a stand-alone unit or as a subsystem in a home refrigerator.

DESCRIPTION OF THE PREFERRED EMBODIMENT

Figures 1, 1B:
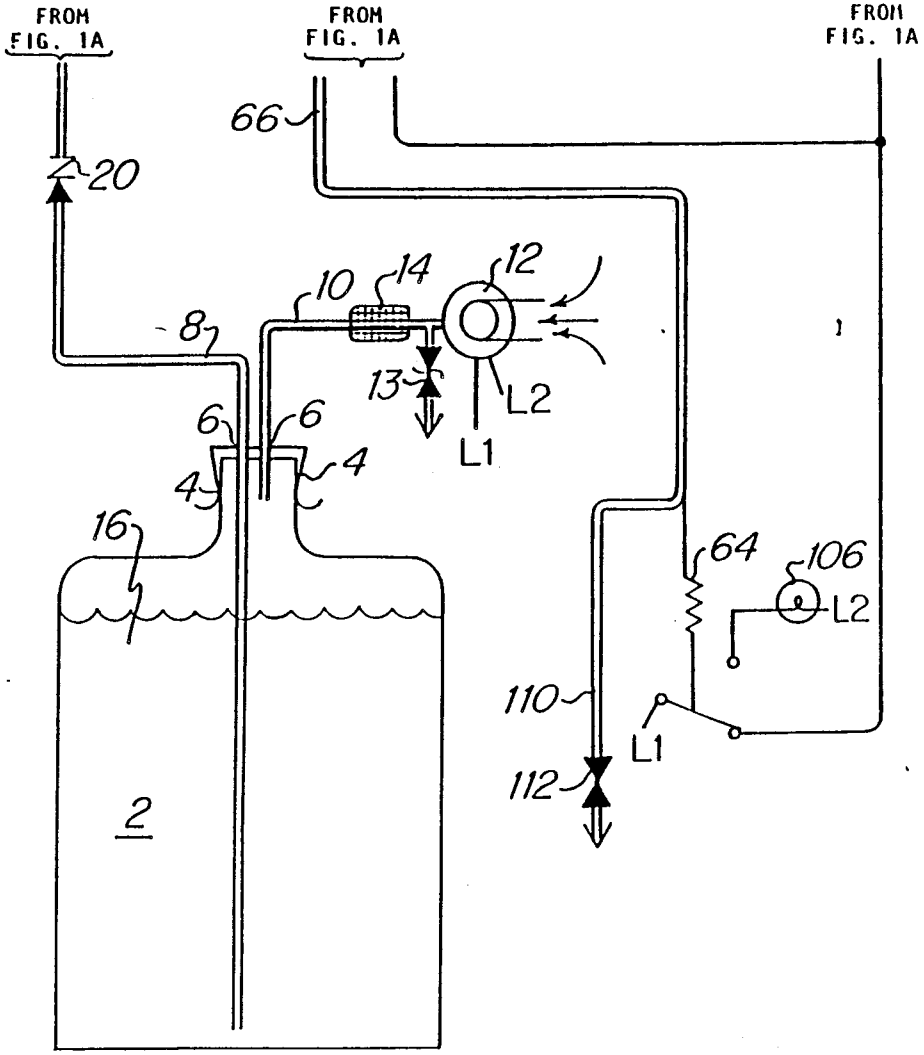
FIGS. 1 and 2 are diagrams showing proper relation of FIGS. 1*a* to 1*b* and 2*a* to 2*b*.
FIGS. 1A and 1B show a pictorial diagram of an embodiment of the carbonator according to the present invention.
Figure 1A:
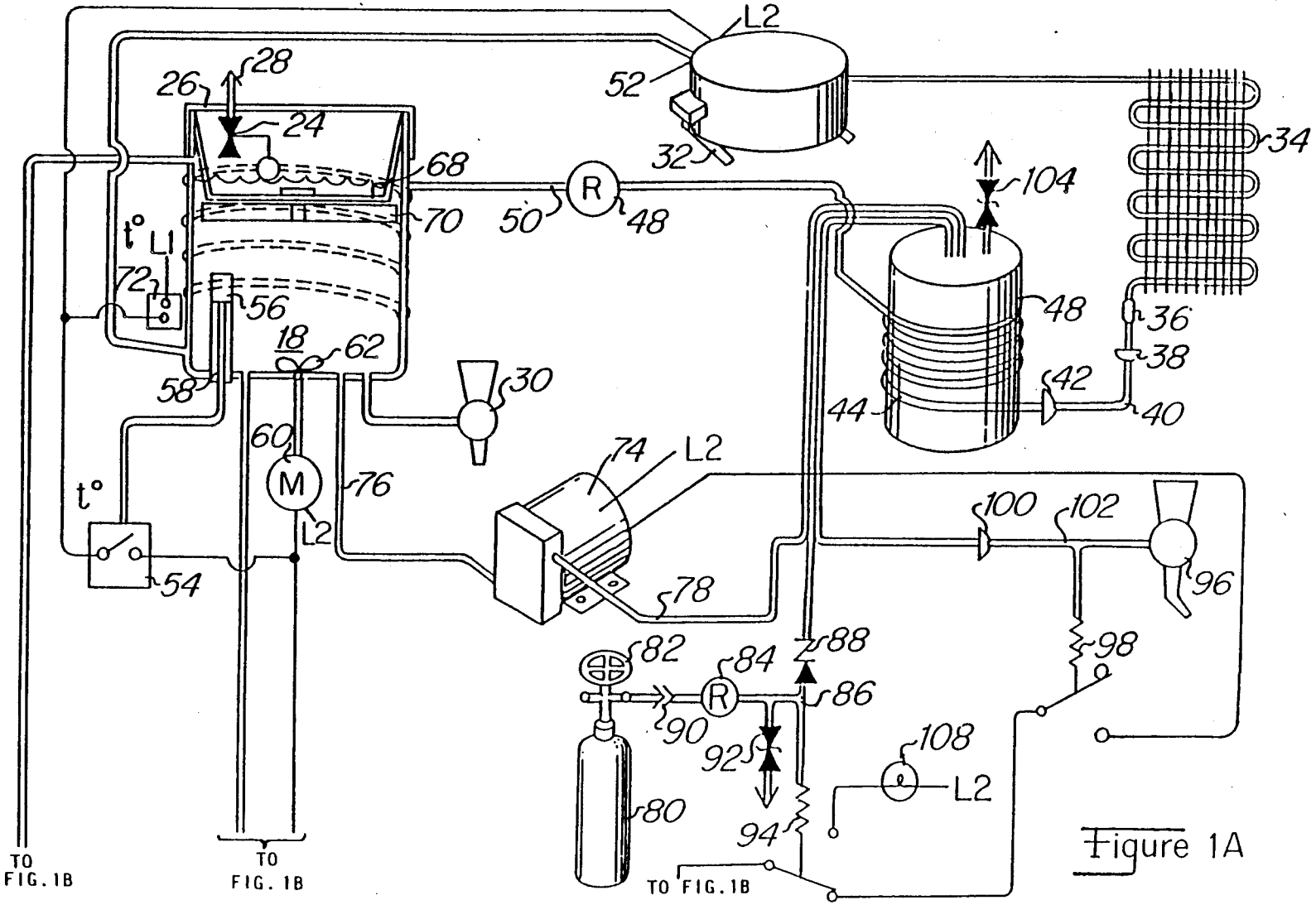

Referring now to FIG. 1, there is shown a pictorial diagram of a bottled water dispensing system including provision for dispensing carbonated water. Hot water dispensing apparatus is not shown but may be added using conventional means. An upright bottle of water 2 is equipped with an air tight cap 4. This cap may be the original cap provided on the sealed bottle of water which is subsequently pierced or, alternatively, a permanent but removable cap which is user serviceable. Air tight seals 6 are provided in cap 4 to permit fluid to be propelled out of the bottle of water via conduit 8 by air supplied via conduit 10 from air pump 12. Since the air supplied may be ambient, it first is filtered by filter 14 of known construction to remove both particulate and microbial matter prior to introduction into contact with the drinking water system. Filter 14 may also be used as deemed desirable to adsorb other airborne contaminants.

Drinking water 16 is propelled via conduit 8 from bottle 2 into reservoir 18. Conduit 8 may be provided with a check valve 20 to prevent water from draining back to bottle 2 when cap 4 is removed for servicing.

Reservoir 18 is equipped with a vent valve 24 which effectively seals reservoir 18 when the liquid level therein rises above a predetermined level. In one embodiment, vent valve 24 may be a floating ball which seals against a seat when the liquid level 22 rises above a predetermined level. Vent valve 24 is coupled to vent port 26 which provides a gas pathway from the inside to the outside of reservoir 18. In order to protect the system against entering airborne contamination, the vent port 26 is provided with filter cap 28. Cap 28 may be equipped with filtration capability ranging from a simple cover to the full contaminant filtration of the type previously described for filter 14. Air pump 12 may be provided with relief means 13 which limits pressure and cools the pump 12, if necessary. With the advent of low cost, low noise, continuous duty air pumps, air pump 12 may operate substantially continuously.

The pressure in bottle 2 needed to propel the water or other liquid therefrom may also be supplied from a regulated supply of gas under pressure, such as a cylinder of gas of nitrogen, air, or other propellant. In such an embodiment it is desirable to inhibit gas flow when the water bottle 2 is empty or near empty. This can be accomplished with level controls appropriately placed in water bottle 2 or reservoir 18 and a solenoid valve disposed downstream from the aforementioned gas cylinder.

Reservoir 18 is equipped with a dispensing valve 30 depending from the bottom thereof which allows liquid to be removed from reservoir 18. Generally, this configuration is useful when the flow rate of liquid desired through valve 30 is greater than the flow rate of liquid entering reservoir 18 from water bottle 2 via conduit 8, i.e., the capacity of air pump or gas source 12 is not sufficient to keep up with the dispensing rate.

In another embodiment of the present invention in which liquid flow into reservoir 18 is sufficient, it can be desirable to operate the system without vent valve 24, vent port 26 and filter cap 28, thus creating a substantially closed reservoir 18. Dispensing valve 30 may then be located near the upper portion of reservoir 18 for dispensing water from this location. In this embodiment, it is desirable to include a drain port located at the lowest point in reservoir 18 in order to permit easy sanitizing and full drain capability.

It should be recognized that the sanitary system of FIG. 1 may be operated successfully in a more conventional manner. Thus reservoir 18 may be opened, vent components 24, 26, and 28 eliminated and bottle 2 inverted into reservoir 10. In this configuration, the air pump 12 and other components associated with propelling the liquid to reservoir 18 may also be eliminated.

Referring now to the refrigeration system of FIG. 1, there is shown compressor 32, the high temperature side of which is connected to condenser 34. Continuing in the direction of refrigerant flow, condenser 34 is coupled to filter-drier 36, the cross section of which necks down 38 into capillary tube 40. The capillary section ends at the transition 42 to evaporator 44. Evaporator 44 is wrapped around carbonator vessel 46. The refrigeration system may further be equipped with an evaporator pressure regulator (EPR) 48 which is used to control the evaporator temperature/pressure in the segment of evaporator 44 between transition 42 and EPR 48. Continuing further in the direction of refrigerant flow, evaporator 44 continues through a low pressure section 50 which is then coiled around reservoir 18 in close thermal contact therewith. The refrigeration loop is completed with connection of the evaporator 44 to the suction Port 52 of compressor 32.

In actual practice, EPR 48 is set to maintain operating refrigerant temperatures/pressures slightly below zero degrees Celsius in the portion of evaporator 44 between transition 42 and EPR 48. The section 50 of evaporator 44 is generally insulated over its length before coiling around reservoir 18, which may be spaced some distance from vessel 46. The pressure drop across EPR 48 usually allows the pressure downstream from EPR 48 to operate at a lower pressure and lower temperature in that portion of evaporator 44, which is wrapped around reservoir 18.

Temperature control within reservoir 18 is attained through use of a temperature or ice bank control 54 having a sensing element 56 disposed in a thermal well 58. Thermal well 58 is in intimate contact with the liquid within reservoir 18. This temperature control makes the use of a liquid-filled ice-bank control that is convenient and effective, particularly when thermal well 58 is placed at a location near the maximum desired limit of ice build-up from the walls of reservoir 18.

In a preferred embodiment of the present invention, reservoir 18 is equipped with means to circulate the liquid contained therein. Thus reservoir 18 is provided with stirring motor 60 coupled to drive impeller 62 as later described in detail herein. Reservoir 18 is also coupled to a water level sensor. In a preferred embodiment, as shown in FIG. 1, a conduit 66 connects reservoir 18 to pressure switch 64. Pressure switch 64 is shown in its operating position when reservoir 18 is nearly full, i.e., above its upper trip limit. In this position, electric current is continuously available to ice bank control 54.

When the level in reservoir 18 falls below a predetermined level, which is generally at or near the level of the ice bank sensor 56, switch 64 switches to its normal unpressurized state. Thus, electrical current to both the compressor 32 and to the stirring motor 60 is terminated.

In certain applications, however, it may not be desirable to stop the compressor 32 when the liquid level falls in reservoir 18 because, for example, warming liquid in reservoir 18 may present sanitation problems, thus making it more advantageous to keep the liquid in reservoir 18 cold at all times, regardless of the liquid level thereof. On the other hand, it is not acceptable to run the compressor 32 continuously without the control function of ice bank sensor 54. In one embodiment of the present invention, line voltage L1 is supplied directly to ice bank controller 54 without being series-wired through pressure switch 64, as shown and a thermal bridge or pathway is provided between the thermal well 58 and the evaporator coils wrapped around reservoir 18. Such a bridge thermally couples the coils to the ice bank sensor 56 to indicate "freeze" condition, even though liquid may not be present in the immediate vicinity thereof.

Alternatively, reservoir 18 can be equipped with a low-cost temperature controller 72 which receives its supply voltage directly but independently from pressure switch 64. Switch or controller 72 may be placed in close thermal contact with the sidewalls or evaporator coils of reservoir 18, and may be set to make contact closure (or conduct) on temperature rises above a predetermined level. Switch 72 may be designed to conduct at 5 degrees Celsius, for example.

In operation, switch 72 will cycle compressor 32 regardless of the water level in reservoir 18 and independentlY of ice bank controller 54 wired as shown. A properly placed and calibrated switch can keep any amount of water chilled in reservoir 18 as a backup to ice bank controller 54.

It should be recognized that other arrangements may be used to control the temperature or volume of ice in reservoir 18. For example, a standard bottled water cooler temperature control with modified temperature set points or temperature differentials may be used. In such an embodiment, the temperature sensing element is generally placed in a well disposed on the exterior of the reservoir 18 in close thermal contact with the evaporator coils wrapped around the reservoir 18.

The principle of operation of such a control is that as ice builds inside the reservoir 18, the thermal load on the system is reduced and the evaporating temperature falls rather rapidly as the ice bank builds. The sensor, in close thermal communication with such an evaporator, activates a controller which turns off the compressor 32. While this configuration offers some advantages, especially in terms of cost, it should be recognized that most of the inexpensive controls on the market todaY use refrigerant-filled sensing elements and differential pressure switches in the controller. This arrangement makes the set points of the control change as a function of altitude. Furthermore, this type of control does not have a sensing element in direct contact with the ice in the reservoir 18. As a result, there is a tendency for the length of the refrigeration cycle to change rather markedly with ambient temperature and this, in turn, can produce profound changes on the size and shape of the ice bank produced. The degree of the ambient temperature effect depends to an extent on the effectiveness of the thermal insulation used.

Alternatively, sensing of evaporator temperature can be useful if an absolute pressure switch is used and the entire unit 15 is protected against wide fluctuations in temperature. Thus if temperature control 72 is not altitude sensitive and operates on electronic principles, for example, this represents a substantial improvement. A further advantage of this type of controller is that the need for controller or switch 72 can be eliminated in configurations where positive cooling of water is required, regardless of level. Other schemes for regulating the volume of ice in the ice bank may also be used, including by sensing the change in electrical conductivity with the change in state from water to ice. While these sensors are more costly than the aforementioned liquid-filled ice bank controls, their very positive action and accuracy can provide control advantages.

Reservoir 18 is further provided with a baffle 68 and an ice crystallizer 70. The purpose of the baffle is to quiet the fluid entering reservoir 18 through conduit 8. Thus, conveying warm water directly to the outlets of reservoir 18 is avoided. The purpose of ice crystallizer 70 is to provide initial crystallization of ice on the first cycling of the refrigeration system.

Generally, the reservoir 18 is formed of plastic or stainless steel. With the reservoir 18 wrapped with refrigeration coils, the inside surface of reservoir 18 is relatively uniform in temperature and such uniformity is enhanced by the liquid circulation created by stirring motor 60 and impeller 62.

On initial start up of the system, cold bands created by localized coils on the outside of reservoir 18 will be distributed so that the localized cold "seen" on the interior of reservoir 18 does not reflect true evaporator temperature. Stated in another way, the circulating water in reservoir 18 is of relatively uniform temperature. As heat from the liquid moves through the walls of reservoir 18 and is absorbed by the evaporator coils, the wall of reservoir 18 serves to distribute the heat.

It has been found in such systems, especially those equipped with stirring means, that initial freezing takes place when the liquid temperature is significantly below 0 degrees Celsius. It is believed that the phenomenon as it applies to the present invention has two components. The first can be ascribed to the known phenomenon of the need to nucleate an ice crystal. Thus, a body of pure water may not freeze even when held at below its freezing point until an ice crystal nucleates someplace in the body which then causes rapid further crystallization. In the absence of such nucleation, it is known that vibrations, scratching and supercooling will bring about initial and rapid crystallization of a super cooled body of water. Second, the circulation resulting from rotating impeller 62 may further impede crystallization. It is believed that the continuous sweeping of the interior sidewalls of reservoir 18 results in more temperature uniformity and therefore more difficulty in maintaining or producing localized supercooled cold spots. The actively moving water may thus impede the initial crystallization.

In one embodiment of the present invention, it has been observed that initial crystallization will take place at about −4 degrees Celsius. A conventional liquid-filled ice bank sensor 26, as discussed above, includes water inside a bulb. Some manufacturers also place seeding compounds such as Aquamarine Beryl Ore therein to aid initial crystallization of the water to ice. This causes the change of state to occur nearer 0 degrees Celsius. One commercial component, the Ranco C-12-1800 control, for example, will freeze (i.e., operate to deactivate compressor 32) at about −3.3 degrees Celsius. If ice has not formed in reservoir 18 by this time, the compressor will cut out and subsequent refrigeration cycles may not initiate the formation of ice with the result that a dispenser thus configured will have very limited drink making capacity. Although the user might "adjust" the operation if the drinkmaking capacity is noticeably limited, this involves a user or installer function which is not desirable.

There is a further difficulty with systems operating with water which is allowed to drop significantly in temperature below 0 degrees Celsius before being brought into the freezing state. It has been observed that the amount of "slush" created in a crystallizing body of water is related to the temperature at which crystallization is first initiated. For example, if circulating water at −1 degree Celsius is seeded with a crystal of ice, generally a large number of very small crystals will develop over a period of about 15 seconds. The temperature of the liquid will rise to about −0.2 degrees Celsius over the crystallization period. Such crystallization normally does not pose a problem for system operation. By contrast, if circulating water at −5 degrees Celsius is seeded, crystallization results in the entire mass of fluid in the reservoir turning to slush over a similar period of time.

Considering the energy relationships and the heat of fusion $H_f$ of water, the temperature as measured in the center of reservoir 18 in the present example rapidly rises from −5 degrees Celsius prior to crystallization to very near 0 degrees Celsius afterward. It does not quite reach this level instantly because the ice, i.e., the solid part of the slush, is below 0 degrees Celsius initially. It has been observed on initial operation of the present invention that the rate of temperature drop of the fluid in reservoir 18 is slower after 0 degrees Celsius temperature is reached. This is of significance since the liquid in reservoir 18 may remain fully liquid at subfreezing temperatures for a significant period of time. If the carbonation pump 74 is operating at a time when the temperature in reservoir 18 causes serious slushing, the ice can enter the inlet of the pump. In actual practice it has been observed, especially with vibrating oscillating pumps, that the initiation of the pumping cycle has brought about crystallization and slushing. The slush can then enter the pump and, in some instances, the discharge line 76 thereof. Such components are prone to clogging. Carbonator 46 is equipped with an internal nozzle of small size which can also clog on small ice particles in the slush. Any clogging thus produced inhibits the carbonation pump 74 from properly moving water into the carbonator 46. In accordance with the present invention, ice crystallization is initiated at a higher temperature, thus avoiding the possibility of large amounts of obstructing slush entering the carbonation system.

The ice crystallizer 70 includes a rotating vane which is disposed to scratch or otherwise impinge upon the interior walls of reservoir 18. Alternatively, a crystallizer which restricts the circulation of water in a location near an evaporator cold band may also be used, as later described herein.

Referring now to the carbonation system of FIG. 1, there is shown carbonator pump 74 operatively coupled to reservoir 18 by conduit 76. The discharge line of pump 74 is coupled to carbonator 46, which preferably has no internal moving parts. Generally, the carbonation pump 74 incorporates one or more check valves therein to prevent backflow of fluid from carbonator 46 into reservoir 18.

Also coupled to carbonator 74 is a source of carbon dioxide gas 80 under pressure which is preferably equipped with valve means 82 to close off the supply of gas. The gas source 80 is generally at high pressure which must be regulated to about 55 psi by the regulator 84 that is connected in conduit 86, which is operatively coupled to carbonator 46. In order to prevent backflow of gas or liquid from carbonator 46, a check valve 88 is provided in conduit 86. In a preferred embodiment, male/female quick connect coupling set 90 can be interposed between regulator 84 and valve means 82. Manual relief valve 92 is also connected to conduit 86 to relieve pressure from the gas lines prior to opening the manual quick connect coupling set 90. Coupling set 90 is preferably constructed to provide a pressure interlock which does not permit the coupling to be disengaged when the system is pressurized.

Thus, the sequence for the changing of the carbon dioxide cylinder 80 is as follows: close valve 82; open relief valve 92 and allow system gas to vent; disengage quick connect coupling set; install new gas source.

Coupled to the low pressure gas system is pressure sensor 94 which operates to transfer contacts from the position shown when the pressure sensed is below a predetermined minimum level. Alternate means may also be used for sensing the presence of adequate carbon dioxide for beverage carbonation. Such alternate means include, for example, devices which sense the weight of the cylinder of carbon dioxide 80 and provide contact transfer when the weight of the cylinder falls below a predetermined minimum level.

Also coupled to carbonator 46 is a dispensing valve 96 and a relief valve 104. The relief valve 104 may be equipped with an orifice to vent the carbonator in response to dispensing, as described in the Related Applications, or it may be a relief valve to prevent over pressure conditions in the carbonator.

Further, a pressure switch 98 is connected to carbonator 46 via dispensing line 102 to detect dispensing and to initiate the operation of carbonation pump 74. A flow restrictor 100 may be included in the dispensing line 102 in order to make certain that the signal received by pressure switch 98 is sufficient to overcome switch hysteresis and delay time associated with contact transfer. Dispensing line 102 may, in addition, take the form of an appropriately sized choke line, as known in the art.

Referring to pressure switches 64 and 94, two pilot lights 106 and 108 are connected to the normally closed (when no pressure is present) contacts of those switches to illuminate when the water bottle and carbon dioxide supplies need replacement.

It can be shown that both replace carbon dioxide indicator lamp 108 and "Replace Water Bottle" indicator lamp 106 cannot both be illuminated at the same time. That is, if the "Replace Water Bottle" lamp 106 is on, the supply voltage to "Replace Carbon Dioxide" indicator lamp 108 is inhibited. If desired, this arrangement can be modified by means which will be obvious to those skilled in the art. It should also be recognized that the pressure switches and other components can be operated at less than main voltage and provide functional equivalent control Pressure switch 64 is also coupled to a drain line 110 which is an extension of conduit 66. Drain line 110 is further provided with a drain valve 112 which may take the form of a small plastic pinch valve which snaps over flexible plastic tubing to make a seal. The drain line 110 and drain valve 112 provide a means for flushing and sanitizing the internal components of pressure switch 64 and for purging air from the ports and diaphragm area of pressure switch 64.

Although no moving parts are required in the carbonator just described, it is possible to substitute therefor a more conventional carbonator including a level sensor disposed in the carbonator tank for mechanically or electromechanically controlling the amount of water in the tank 46.

The operation of the carbonation system of the present invention depends for proper operation upon the phenomenon observed and documented in the aforecited Related Applications pertaining to the volumetric absorption of carbon dioxide gas in a carbonator being dependent upon the temperature of the water in the carbonator. For a carbonator with rapid liquid throughput, this may effectively translate to the temperature of the incoming liquid.

While there are other complicating factors such as the presence of atmospheric gases, and carbonator efficiency it can be said for many practical applications, including the bottled water application of the present invention, that the volumetric absorption of gas in the carbonator is predominantly determined by temperature of the liquid. This is the case, however, only when the pressure generated and held by air pump 12 is slightly over 1 atmosphere absolute and the desired lift is small. Ordinarily, this will be on the order of a few feet. In this manner, the maximum dissolved air in the water in bottle 2 and reservoir 18 is kept only slightly above equilibrium with 1 atmosphere absolute. The maximum air pressure in the head space above the liquid in the carbonator will also be near 1 atmosphere absolute.

In operation, when a new bottle 2 of water 16 is put into place and electricity is supplied to the system, pump 12 begins to pressurize the air space above water 16 in bottle 2. Water is displaced through conduit 8 and check valve 20 into reservoir 18. As filling of reservoir 18 proceeds, the water level surpasses the contact transfer point set on pressure switch 64 causing "Replace Water Bottle" indicator lamp 106 to extinguish. The same contact transfer supplies current to stirring motor 60 and to compressor 32 through ice bank control 54. Operation of stirring motor 60 causes the water and ice crystallizer 70 to rotate.

Operation of compressor 32 causes refrigerant to flow through condenser 34, filter drier 36, capillary tube 40, evaporator 44, ERP 48, then back to the compressor 32 via suction port 52.

The water in reservoir 18 is thereby chilled. As the temperature approaches 0 degrees Celsius, the crystallizer 70 precipitates ice at a water temperature slightly above or below this temperature.

An ice bank subsequently begins to form and continues to grow inside reservoir 18 until it extends to a point near ice bank sensor 56. As the ice bank extends to the thermal well in which the sensor 56 is housed, the liquid in the sensor will freeze and deliver a pressure pulse to ice bank controller 54 which turns off the compressor 32. Thereafter, the refrigeration system will cycle periodically as heat enters the system and dissolves a portion of the ice bank to expose the thermal well 58 in the vicinity of ice bank sensor 56.

Cold water near 0 degrees Celsius may now be dispensed from dispense valve 30, or be drawn off by carbonator pump 74 and supplied to the carbonator 46. As water is dispensed from reservoir 18 and tepid water enters from water bottle 2, it is rapidly chilled by the action of the circulating water against the ice bank. When carbonated water is dispensed through valve 96, the pressure on pressure switch 98 falls rapidly due to the pressure drop across flow restrictor 100. In one embodiment when the pressure drops below 45 psi, the contact on switch 98 falls to its normally closed (unpressurized) position. If there is sufficient carbon dioxide and sufficient water in reservoir 18, as evidenced by the positions of pressure switches 94 and 64 respectively, carbonation pump 74 will be turned on. The carbonation pump 74 draws near-freezing water from reservoir 18 and delivers it to the inlet nozzle of carbonator 46 to fill the vessel.

During the dispensing of carbonated water from dispense valve 96, carbon dioxide gas flows from source 80, through quick-connect coupling set 90, regulator 84, conduit 86 and check valve 88 to displace at least a portion of the liquid volume dispensed. Gas continues to flow into carbonator 96 until the regulator set point is reached at about 55 psi.

When dispensing is complete, carbonation pump 74 continues to operate because the flowrate therethrough is less than the flowrate at which the carbonated water was dispensed. As the carbonator 46 fills with near-freezing water, some carbon dioxide gas may continue to flow from source 80 into carbonator 46, as demanded, to maintain the 55 psi set point in the carbonator. As the carbonator continues to fill, the liquid level in carbonator 46 reaches a level where the efficiency of carbonation begins to fall. (It has been found that in carbonators of approximately 4 inches in diameter and 9 inches in height, the efficiency of carbonation drops quickly as the distance between the liquid level and the nozzle (which is disposed near the top of carbonator 46) decreases to less than two inches.) The drop in the efficiency of carbonation is manifested as a reduction in the gas flowrate into carbonator 46 during filling (without dispensing). As the liquid level rises, the flow of gas from source 80 stops completely (indicating the condition of unitary volumetric absorption), followed by a rise in pressure as the liquid level in carbonator 46 nears the level of the inlet nozzle at the top of the vessel. When the pressure in carbonator 46 reaches approximately 60 psi, switch 98 resets to its original position shown in FIG. 1, thus turning off carbonation pump 74. Filling of the carbonator 46 is complete and a full charge of carbonated water is ready to dispense.

The present invention thus relies upon the physical properties of the fluid in the carbonator 46 to generate a pressure signal which can be sensed through the fluid lines connected to the carbonator. It is for this reason that carbonator 46 can be operated without conventional internal level controls, and without the use of electrical lines to the carbonator.

It can be shown that the present system will not allow large quantities of warm water to enter the carbonator 46. As an example, water entering the carbonator at 20 degrees Celsius during system start up (i.e., before the refrigeration system has had an opportunity to cool reservoir 18) exhibits maximum volumetric absorption of pure carbon dioxide at 55 psi of about 0.86 volumes of gas for each volume of water. In practice, however, the amount of gas actually absorbed decreases because the carbonation process is less than 100 percent efficient, and decreases further when atmospheric gasses are present. Thus, typical volumetric absorption in the above example is about 0.7 volumes, or less.

In practice this phenomenon leads to a rapid increase in carbonator pressure before the carbonator is full. Thus, pressure switch 98 deactivates the carbonator pump 74 in a short time after the carbonator begins to fill. It is, therefore, common with this type of system for the carbonator to fill only slightly on start up. This has the advantage, especially for operation of the system as a home dispenser, that dispensing of a large quantity of warm carbonated water is inhibited by the system of the present invention.

One important feature of the present invention is the ability to 'tune' the system to specific carbonator operating conditions. Since carbonator efficiency, the level of atmospheric gasses, and temperature all affect volumetric absorption within the carbonator, these factors may be used to control such absorption. Further, if two of the variable conditions can be held constant, the volumetric absorption can be controlled by the remaining variable condition. In one embodiment of the present invention, the practical significance of this is that volumetric absorption controls the liquid level in the carbonator. Also, the temperature of the system of the present invention, both in the carbonator and in the inlet liquid, is controlled. Further, many sources of bottled water are aerated during processing or are obtained from aerated sources and are delivered in a relatively well aerated state.

If air is used to pressurize water bottle 2, the water therein and reservoir 18 will tend to aerate and come to equilibrium over time. The remaining variable,(i.e., the efficiency of carbonation, may be controlled by various means including input flowrate, pressure drop across the inlet nozzle, and carbonator design parameters such as surface area of liquid, orientation of the inlet nozzle, and the like.

It can be shown that a system which is efficiency tuned, for example, to provide a volumetric absorption slightly over 1.0 volume of gas per volume of liquid when operated at 0 degrees Celsius and 1 atmosphere of dissolved air, becomes quite sensitive to temperature variation. That is, volumetric absorption falls below 1.0 quickly when the operating temperature of such a system rises above 0 degrees, in substantial correlation with the solubility curve of carbon dioxide in water. These physical properties are used in the carbonated-water dispensing system of the present invention to inhibit the dispensing of large volumes of carbonated water when the system is operating at temperatures above predetermined design levels.

Figure 2A:
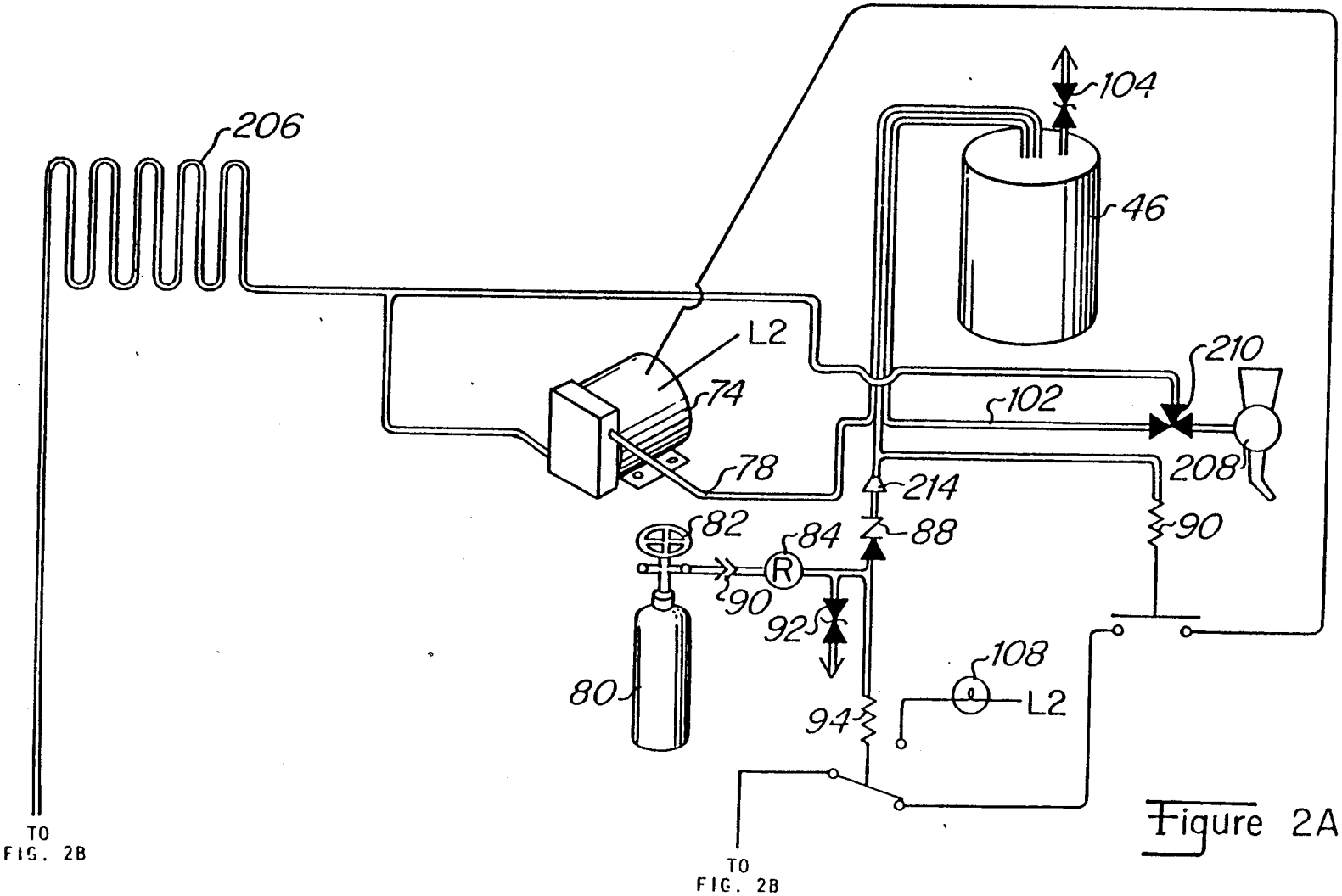
FIGS. 2A and 2B show a pictorial diagram of the carbonator according to another embodiment of the present invention for operation in a conventional refrigerator.
Figures 2, 2B:
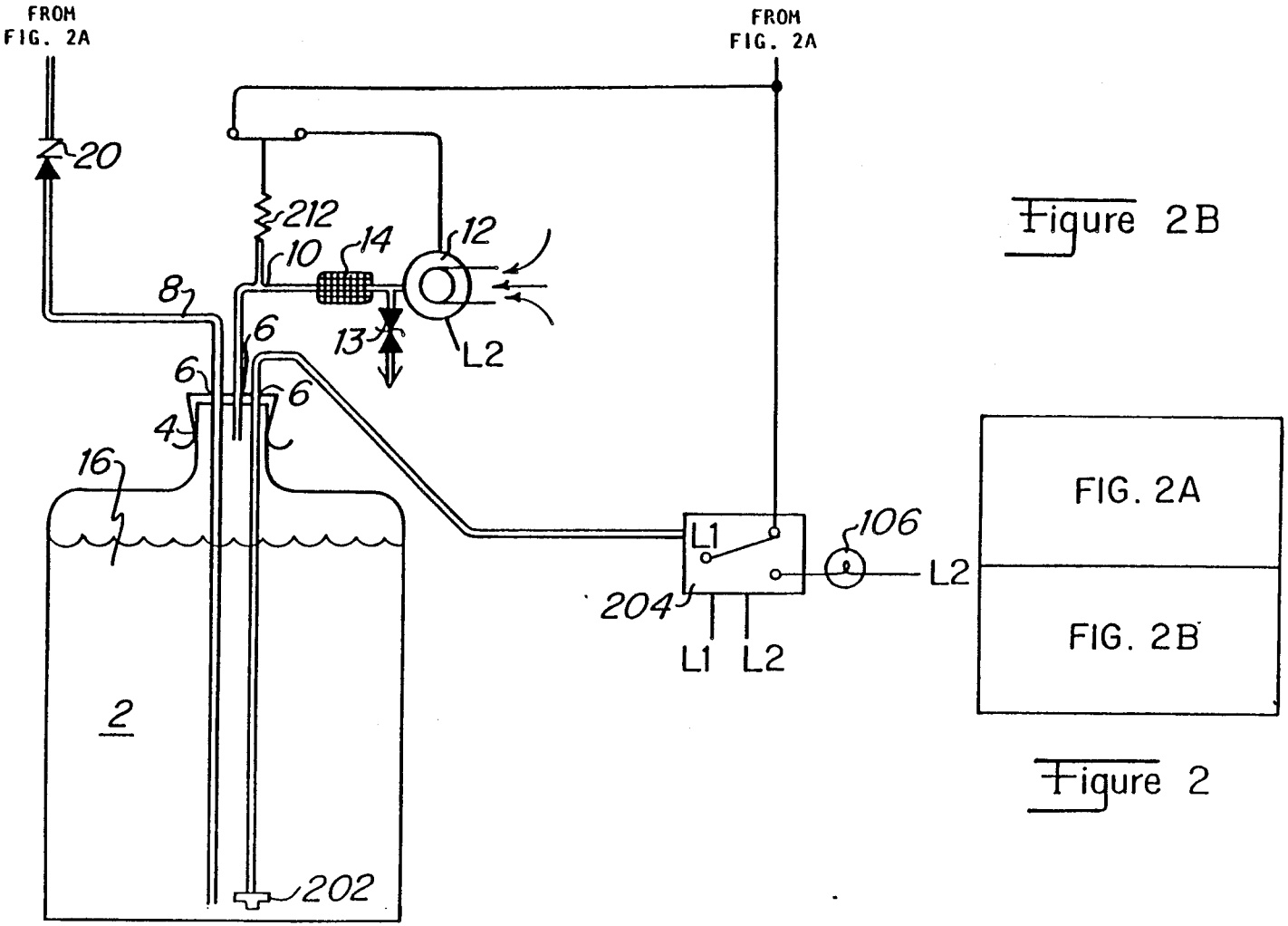

Referring now to FIG. 2, there is shown an alternate embodiment of the present invention adaptable for use in a home refrigerator. The functional components of the system that are the same as in FIG. 1 bear similar legends.

Bottle 2 is generally placed in a convenient location outside the refrigerator such as under the sink or in the garage. Bottle 2 is operatively coupled to a level sensor 202 and a level controller 204. The function of the sensor and controller 202, 204 is to inhibit the flow of electricity at least to pump 74 when the water level in the bottle 2 drops below a predertermined level. Conventional level sensing, for example, including sensing the weight of bottle 2, electrical conductivity sensing, optical means, pressure sensing means, and float switch means may be used.

It is desirable in the upright bottle configuration shown to empty almost completely the bottle of water 2 before the sensor 202 delivers its signal to controller 204 to turn off the pump circuit. It is therefore desirable that the sensing means be repeatably sensitive and reliable when the water level in bottle 2 is very low. Sensors, for example, using electical conductivity principles or optical sensing can provide advantages in this regard. It should be noted, however, that the electrical conductivity sensors if used need to be sufficiently sensitive to effectively trigger when distilled or purified water in supplied. Optical sensors of known construction employ the difference in the index of refraction of air and water to detect the presence of water in the bottle 2. Thus probe 202 may be lowered almost to the bottom of bottle 2.

The system of FIG. 2 is further provided with a chiller reservoir 206 which is placed within the chilled environment, for example, of a refrigerator. It is desirable for reservoir 206 to incorporate structures which induce 'plug' flow of water and may also incorporate therein means for rapidly passing air bubbles therethough, as known in the art.

Instead of the two faucet dispensing system of FIG. 1, there is shown in FIG. 2 a single dispense valve 208 which has a three way valve 210 disposed upstream therefrom. By adjusting valve 210 as desired, either chilled or carbonated water may be dispensed through valve 208.

When water is demanded, either by dispensing carbonated or chilled water, water from bottle 2 is propelled by air pump 12 through chiller reservoir 206. In addition to the controls indicated in FIG. 1, a pressure switch 212 may be operatively coupled to the system pressurized by air pump 12. This switch may be connected to inhibit the flow of electricity to air pump 12 when the system pressure exceeds a predetermined minimum level. Thus, air pump 12 may be operated on demand.

The carbonation system is driven by a carbonation pump 74 whose inlet is connected to receive the water from bottle 2. In FIG. 2, the carbonation pump 74 has an inlet which is downstream from chiller reservoir 206. Such a configuration can be convenient in original equipment applications where subjecting chiller reservoir to high pressures may not represent optimum safety design configuration relative to possible system leaks. Such original-equipment configurations may also include control valves to inhibit the flow of water from bottle 2 to the interior of the refrigerator cabinet under certain conditions such as in the absence of dispensing or under 'vacation' or 'off' control settings.

It should also be noted that carbonation pump 74 may be interposed in conduit 8 so that the inlet of pump 74 is in direct contact with the water 16 in bottle 2. In this configuration it is necessary to provide conventional means connected to prevent backflow into the fresh water inlet supply from carbonator 46. Further, air pump 12 and optional associated control 212 may be eliminated from the illustrated embodiment of FIG. 2 if pump 74 serves both as a dispensing pump and as a carbonation pump with the capability of handling both chilled water and carbonator flow rate demands. However, since high flow, high pressure pumps of the type required to create good beverage carbonation are generally expensive, the embodiment using a single pump, as described above, may not be the low-cost embodiment, even though components such as air pump 12 and pressure switch 212 may be eliminated.

In the embodiment of FIG. 2, a flow restrictor 100, as in FIG. 1, is eliminated (although conduit 102 may still be as a choke line), and flow restrictor 214 is included in the carbon dioxide supply line leading to carbonator 46 to provide a slight pressure drop when fluid is dispensed from the carbonator, which pressure drop can be sensed by pressure switch 98 operatively coupled to the carbonator.

Pressure switch 98 may also be connected in the discharge side of pump 74 or in disharge line 78. It is generally necessary in such an embodiment to adjust the control pressure level or hystereses operating conditions of the switch 98.

In the embodiment of FIG. 2 in a home refrigerator application, it is possible to locate all of the electrical components remote from the carbonator 46 which is best disposed within the refrigerator for retrofit applications.

Figure 3:
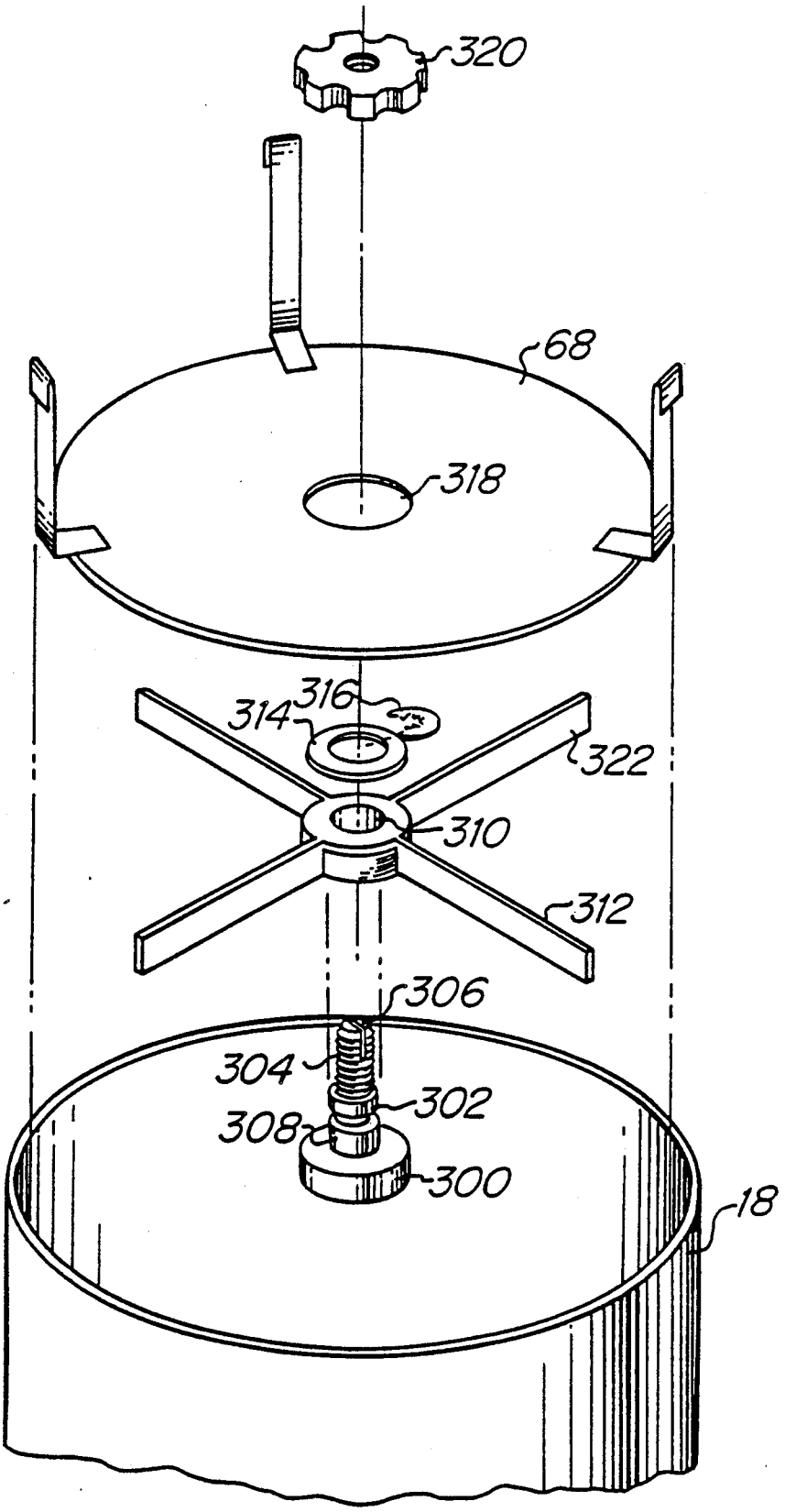
FIG. 3 is an exploded view of the ice crystallizer according to one embodiment of the present invention.

Referring now to FIG. 3, there is shown one version of a crystallizer which may be used in the embodiment of the present invention illustrated in FIG. 1. There is shown a baffle 68 having a hole in the center through which the spindle 300 is positioned. Spindle 300 is equipped with a grooved portion 302, a threaded portion 304 and a slotted area 306. The shank portion 308 of spindle 300 fits through an oversize hole 310 in rotary vane 312. The tip to tip dimension of rotary vane 312 is slightly less than the internal diameter of reservoir 18. Assembly of spindle 300 to rotary vane 312 is completed with washer 314 and is secured with snap ring 316. The threaded portion 304 of spindle 300 protrudes above the snap ring 316 sufficiently to be secured to baffle 68 through hole 318 with knurled nut 320.

In operation, the liquid movement within the resevoir 18 produced by rotating impeller 62 causes rotary vane 312 on the underside of baffle 68 to rotate inside reservoir 18. The oversize hole 310 allows rotary vane 312 some freedom of movement about its rotational axis which, given the dimensions of the vane 312, allows the vane tips 322 to impinge on the interior sidewalls of reservoir 18. When the fluid in reservoir 18 is near or below freezing, repeated impingement from the vane tips 322 cause crystallization of the water in reservoir 18.

Figure 4:
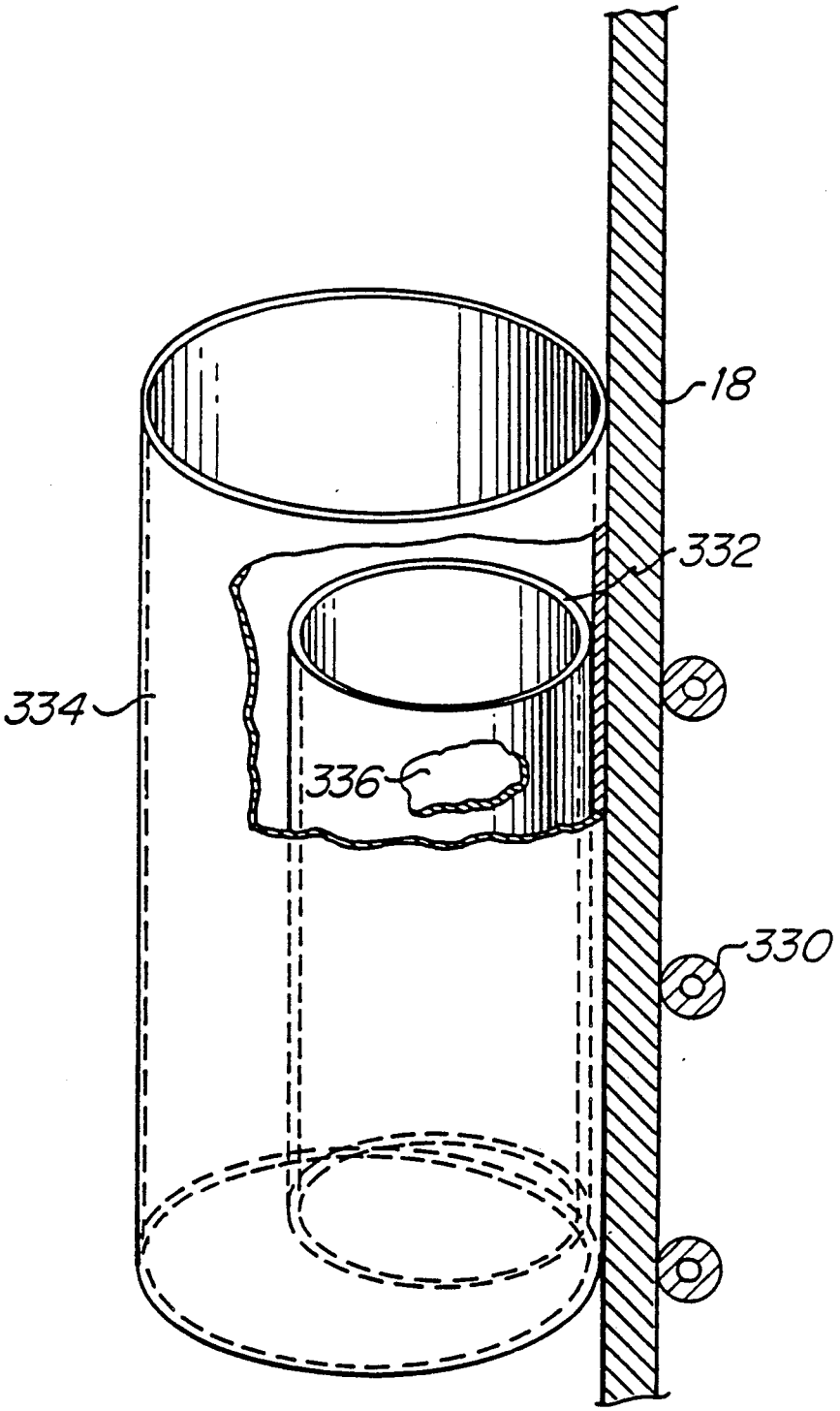
FIG. 4 is a partial sectional view of an ice crystallizer according to another embodiment of the present invention.

Referring now to FIG. 4, there is shown an alternate means of initiating crystallization. Reservoir 18 is wrapped with refrigeration evaporator coils 330 in close thermal communication with the sidewalls of the resevoir 18. A small tube 332 is housed within a larger tube 334, both of which are affixed to the interior sidewall of reservoir 18. The function of the tube within a tube design is to provide a sheltered environment or quiescent conditions in the chilled water in the interior portion of the inner tube 332 is that cooled by the close proximity of evaporator coils 330 to promote nucleation or initial crystalization. In a top-feed evaporator system, it is found that the coldest point in the system is near the capillary tube inlet, and the crystallizer of FIG. 4 is located near this point on the side wall of resevoir 18 for enhanced operation. The effectiveness of a crystallizer may be determined by the water temperature in reservoir 18 at which the first crystals of ice are formed.

Figure 5:
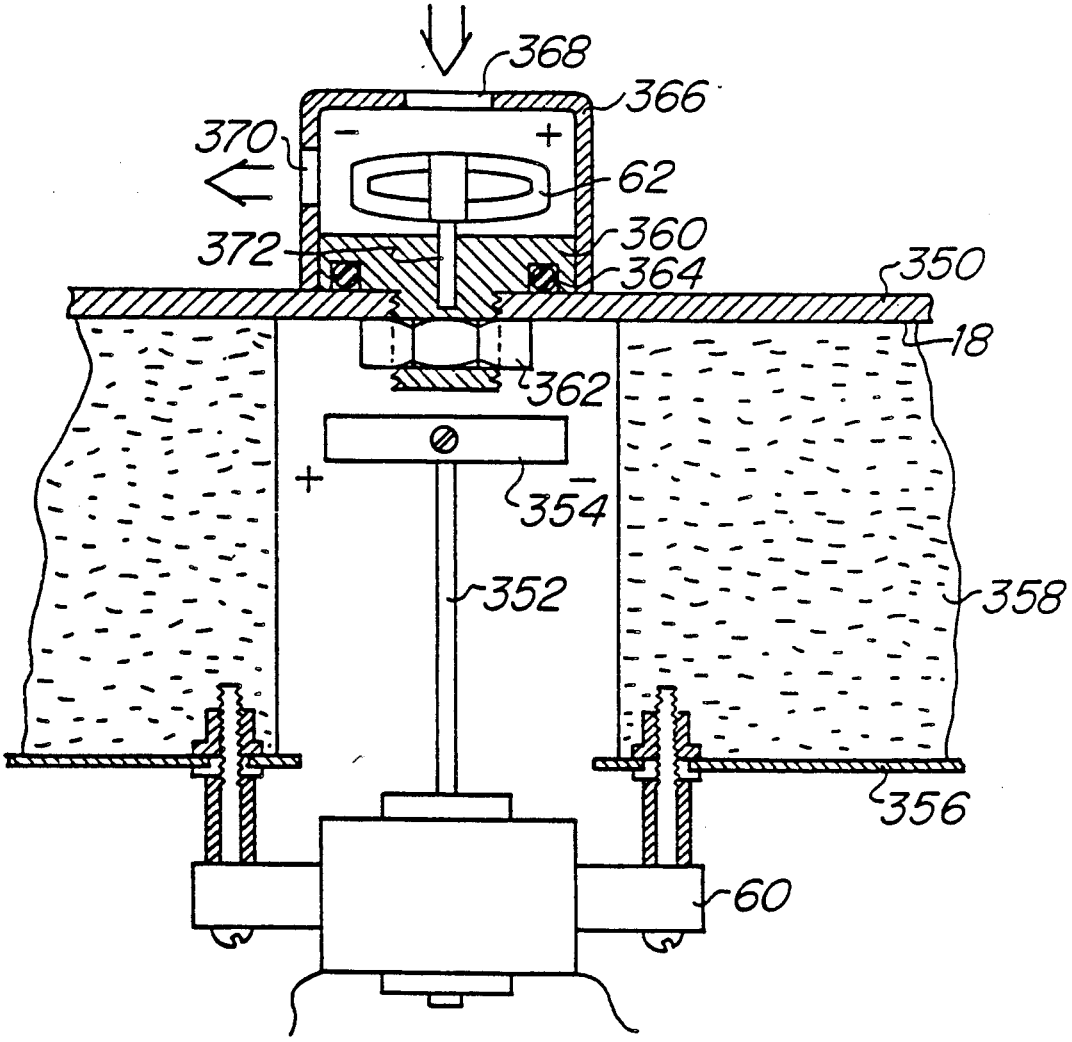
FIG. 5 is a sectional view of a stirring mechanism according to the present invention.

Referring now to FIG. 5, there is shown an embodiment of the stirring mechanism in the illustrated embodiment of FIG. 1. Stirring motor 62 is diposed below the level of the bottom 350 of reservoir 18. In this position, the same stirring mechanism may be used when the top of reservoir 18 is open to receive an inverted bottle of water, or is configured for operation with an upright bottle, as illustrated in FIG. 1. Motor 60 is coupled to drive shaft 352 at the end of which a magnetic bar 354 is affixed. Motor 60 may be mounted to reservoir support pan 356 as shown which is separated from the bottom 350 of reservoir 18 by styrofoam insulating material 358.

Reservoir bottom 350 is outfitted with a stationary seal and bearing 360. The bearing orifice 372 of the seal bearing 360 is provided to aid centering of magnetic impeller 62. The seal against reservoir bottom 350 is formed with o-ring 364 compressed by the tightening of nut 362.

The stirring mechanism is also provided with a shroud 366 having an inlet orifice 368 and an outlet orifice 370. The inlet orifice is disposed in the top of the shroud 366 and the outlet orifice is disposed in the side of the shroud.

This arrangement effectively creates a small pump in reservoir 18, the outlet of which can be directed circumferentially to produce a steady rotating mass of liquid in reservoir 18.

In operation, motor 60 drives magnetic bar 354 which is magnetically coupled through the bottom of reservoir 18 to the magnetic impeller 62, and the two magnets rotate in concert with one another, thus providing a pumping action within shroud 366 that circulates the water in reservoir 18.

Figure 6:
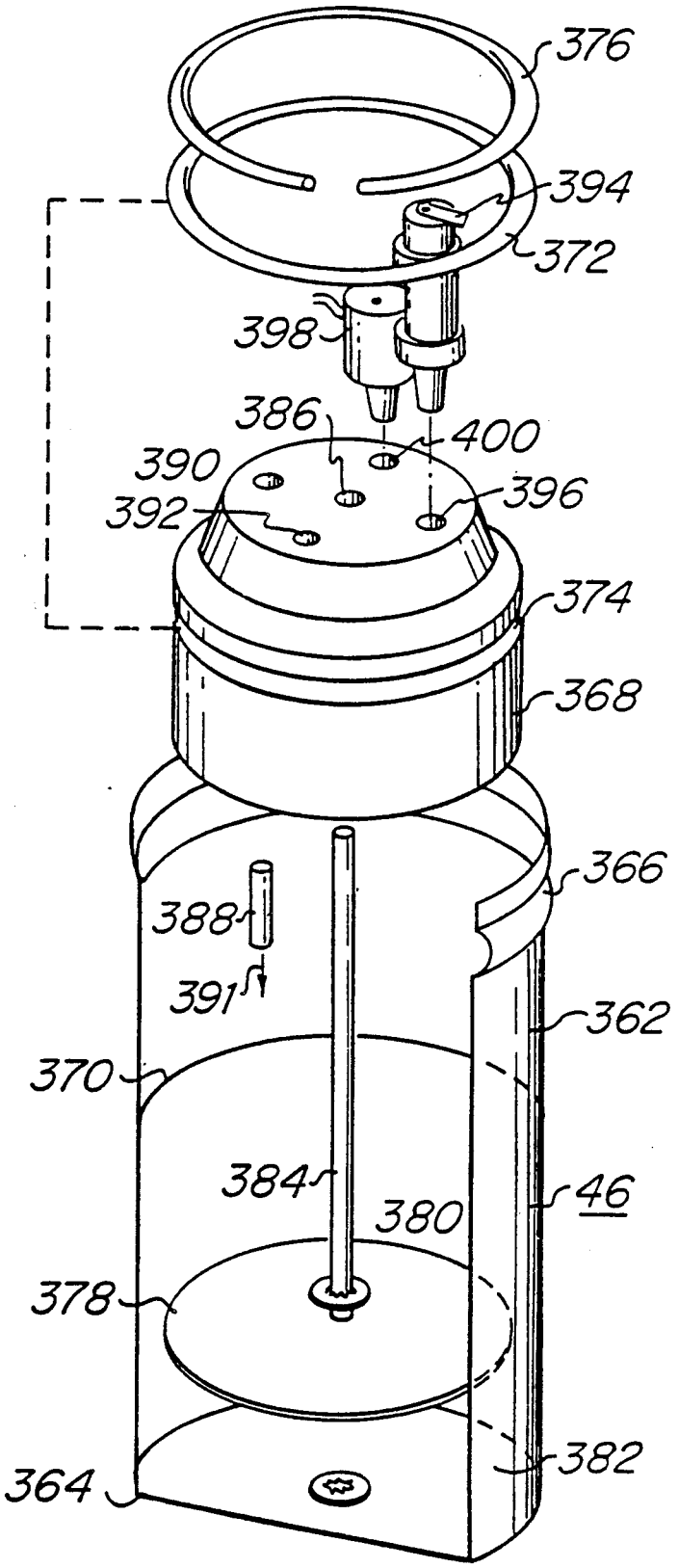
FIG. 6 is an exploded partial cutaway view of the carbonator according to one embodiment of the present invention.

Referring now to FIG. 6, there is shown an exploded partially cutaway view of the carbonator of the present invention. Carbonator 46 includes an outer shell 362 which forms one part of a presure vessel. Shell 362 may be formed of stainless steel and may be deep drawn or welded into the shape shown. Further, it is possible to mold the shell 362 from thermoplastic material such as polycarbonate. The lower end 364 of shell 362 may be hemispherical or otherwise rounded to increase the pressure holding capability thereof.

Shell 362 is equipped with an indented bead portion or groove 366 which is used to retain plug 368, as described below, and which may be roll formed or molded into place.

Carbonator plug 368 is demensioned to fit into shell 362 to a point determined by lip 370 of shell 362. This lip may be machined or molded into place in shell 362. Alternatively, lip 370 may take the form of a ridge or protrusion at the point indicated which limits insertion of plug 364 beyond the point indicated.

Prior to fitting plug 368 into place, an o-ring seal (not shown) is placed in o-ring groove 374 which effectively retains the o-ring when the plug 368 is assembled within the shell 362. When the seal is lubricated and plug 368 is pressed into place in shell 362, a gas and liquid tight seal is formed between the plug 368 and the shell 362. Final assembly is completed by fitting plastic or metal ring 376 into place within groove 366 above the top of plug 368. Ring 376 may be provided with a slight outward spring bias so that it expands and snaps into place in groove 366.

Carbonator 46 is also provided with a baffle 378 that is retained by retaining rings 380 and 382 on the outlet tube 384. It is convenient that baffle 378 be positioned to segregate a "quiet" volume of water below the baffle from the volume of water above the baffle that is agitated by incoming water as known in the art.

Outlet tube 384 is inserted directly into a port (not shown on FIG. 6) disposed on the underside of plug 368 and in fluid communication with outlet port 386 of carbonator plug 374. In a similar manner, liquid inlet nozzle 388 is connected in direct fluid communication with liquid inlet port 390 and is equipped with a nozzle 391 to direct a stream of incoming liquid substantially downwardly. Gas inlet port 392 is in direct fluid communication with the interior of the carbonator 46. In the embodiment illustrated in FIG. 6, the carbon dioxide enters at a level above the level of the liquid in the carbonator 46. A tube may be inserted, if desired to direct gas flow below the operating levels of liquid within the carbonator.

Plug 368 is also provided in the embodiment shown with a relief valve 394 and relief valve port 396. Plug 368 may further be provided with a solenoid vent valve 398 and with a vent valve port 400.

One feature of carbonator 46 and plug 368 is that the fittings which conduct fluids in and out of the carbonator may be molded into place by conventional injection molding processes to facilitate quick-connect assemblage of the components. Thus, ports 396 and 400 may include standard female threads, and ports 386, 390, and 392 and their underside counterparts (not shown) may be of the conventional push-in, quick-connect type. Such fittings and components are commercially available, for example, from John Guest U.S.A. and have features that allow extremely easy insertion and release. Incorporation of these fittings as an integral component of plug 368 involves a sonic welding of a cap (not shown) into place to complete the assembly of plug 368. The nozzle 388 and outlet tube may therefore be easily serviced or replaced as necessary. Similarly, the tubing which connects to ports 386, 390, and 392 may be simply inserted or removed for assembly or servicing.

Figure 7:
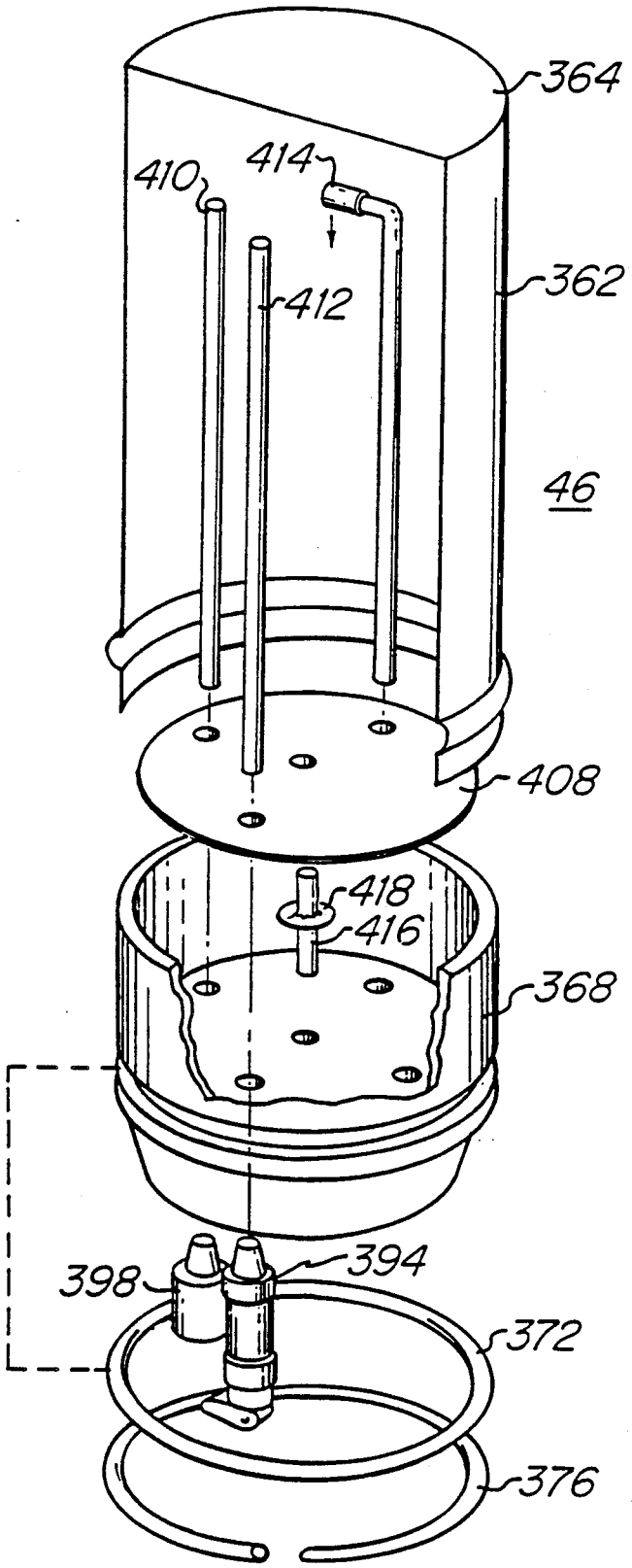
FIG. 7 is another exploded partial cutaway view of the carbonator according to another embodiment of the present invention.

Referring now to FIG. 7, there is shown an inverted form of carbonator 46, the plug 368 of which is identical to that in FIG. 6. Some of the push-in, quick-connect ports have been exchanged in the inverted model, however, to accommodate the new internal components. These components include vent tubes 410 and 412 to provide gas communication from the gas space shown above the operational liquid level to solenoid valve 398 and vent valve 394, respectively. Baffle 408 is modified to provide additional orifices for tubes or conduits therethrough, and nozzle 414, which directs the incoming stream of liquid substantially downwardly, is disposed in the gas space above the operating liquid levels within the carbonator. Other nozzle arrangements are, of course possible. In another embodiment, the liquid stream can be directed against impact plates, or spayed, etc. Carbon dioxide inlet tube 416 directs the incoming carbon dioxide gas just above baffle 408 which is suspended above the underside of plug 368 by a retaining ring 418 on conduit or tube 416. A second retaining ring (not shown) may be placed on top of carbon dioxide inlet tube 416 to retain the baffle 408 in place.

What is claimed is:

1. A carbonation system comprising:

a carbonator operatively coupled to receive a source of liquid to be carbonated and a source of carbon dioxide under pressure;

means for chilling the liquid to be carbonated supplied to the carbonator;

means for dispensing the carbonated liquid from the carbonator;

first means for sensing the presence of adequate liquid to be carbonated operatively coupled to said source of liquid to be carbonated;

second means for sensing the presence of carbon dioxide gas;

pressure sensing means coupled to said carbonator; and control means responsive to first and second means and to said pressure sensing means to initiate the flow of liquid to be carbonated into said carbonator during the dispensing and to inhibit the flow of liquid to be carbonated into said carbonator in response either to said first or said second means sensing the insufficient supplies of liquid to be carbonated or carbon dioxide or to the pressure sensing means sensing pressure exceeding a predetermined level.

2. A carbonator system as in claim 1 wherein said means for chilling forms and maintains within the source a quantity of ice within a selected thickness range.

3. A carbonation system to dispense carbonated water from a source comprising:

pressurizing means operatively connected to pressurize the water in a source:

means forming a fluid pathway for water from the source to a reservoir for holding a quantity of water from the source;

means for chilling in said reservoir the water delivered thereto from said source, and including means for forming a selected volume of ice within said reservoir;

said means for forming inclutding means in contact with water in the reservoir for introducing vibration into water in the reservoir for initially crystallizing ice therein;

a carbonator;

conduit means for delivering chilled water under pressure from said reservoir to said carbonator;

means coupling a source of carbon dioxide to said carbonator; and means coupled to said carbonator for dispensing carbonated water therefrom.

* * * * *